US011378055B1

(12) United States Patent
Sim et al.

(10) Patent No.: US 11,378,055 B1
(45) Date of Patent: Jul. 5, 2022

(54) METHOD OF CONTROLLING IGNITION COIL

(71) Applicants: HYUNDAI MOTOR COMPANY, Seoul (KR); Kia Corporation, Seoul (KR)

(72) Inventors: Kiseon Sim, Suwon-si (KR); Dongwon Jung, Gwacheon-si (KR); Won Gyu Kim, Seoul (KR); Jin Oh Song, Hwaseong-si (KR); Soo Hyung Woo, Seoul (KR)

(73) Assignees: HYUNDAI MOTOR COMPANY, Seoul (KR); KIA CORPORATION, Seoul (KR)

( * ) Notice: Subject to any disclaimer, the term of this patent is extended or adjusted under 35 U.S.C. 154(b) by 0 days.

(21) Appl. No.: 17/476,999

(22) Filed: Sep. 16, 2021

(30) Foreign Application Priority Data

Feb. 5, 2021 (KR) ..... 10-2021-0016578

(51) Int. Cl.
*F02P 9/00* (2006.01)
*F02P 3/02* (2006.01)

(52) U.S. Cl.
CPC ..... *F02P 9/002* (2013.01); *F02P 3/02* (2013.01)

(58) Field of Classification Search
CPC ..... F02P 9/002; F02P 3/02
See application file for complete search history.

(56) References Cited

U.S. PATENT DOCUMENTS

| | | | | |
|---|---|---|---|---|
| 9,429,134 | B2 | 8/2016 | Desai et al. | |
| 10,006,432 | B2 | 6/2018 | Desai et al. | |
| 2015/0152832 | A1* | 6/2015 | Desai | F02P 9/002 123/625 |
| 2017/0292492 | A1* | 10/2017 | Inada | F02P 1/083 |

* cited by examiner

*Primary Examiner* — Jacob M Amick
(74) *Attorney, Agent, or Firm* — Morgan, Lewis & Bockius LLP

(57) ABSTRACT

An ignition coil control method may include receiving first pulse signal and second pulse signal following the first pulse signal by a delay time transmitted from an engine control unit; charging the first ignition coil when the first pulse signal is on; charging the second ignition coil when a predetermined time period elapses from a time at which the first pulse signal is on; discharging the first ignition coil when the first pulse signal is off; discharging the second ignition coil when a maintaining time of the first pulse signal from a time at which the second ignition coil is charged; when the second pulse signal is on, charging the first ignition coil for a dwell time and then discharging the first ignition coil; and charging the second ignition coil for the dwell time and then discharging the second ignition coil when a predetermined time period elapses from a time at which the second ignition coil is discharged.

12 Claims, 5 Drawing Sheets

METHOD OF CONTROLLING IGNITION COIL

CROSS-REFERENCE TO RELATED APPLICATION

The present application claims priority to Korean Patent Application No. 10-2021-0016578 filed on Feb. 5, 2021, the entire contents of which is incorporated herein for all purposes by this reference.

BACKGROUND OF THE INVENTION

Field of the Invention

The present invention relates to a method of controlling an ignition coil. More particularly, the present invention relates to method of controlling an ignition coil which may supply a current to an electrode of a spark plug through two ignition coils.

Description of Related Art

In gasoline vehicles, a mixture of air and fuel is ignited by a spark generated by a spark plug to be combusted. That is, the air-fuel mixture injected into a combustion chamber during a compression stroke is ignited by a discharge phenomenon of the spark plug, and thus energy required for vehicle's driving is generated while undergoing a high temperature and high pressure expansion process.

The spark plug provided in the gasoline vehicle serves to ignite a compressed air-fuel mixture by spark discharge caused by a high voltage current generated by an ignition coil.

In a spark plug mounted on a conventional gasoline vehicle, spark discharge between a pair of electrodes (a center electrode and a ground electrode) is generated by the high voltage current induced from the ignition coil, and in the instant case, difficulties exist in controlling a discharge period of the spark plug according to an operational condition of an engine.

The information disclosed in this Background of the Invention section is only for enhancement of understanding of the general background of the invention and may not be taken as an acknowledgement or any form of suggestion that this information forms the prior art already known to a person skilled in the art.

BRIEF SUMMARY

Various aspects of the present invention are directed to providing an ignition coil control system and method which may variously control an ignition timing and discharge period of spark discharge generated between a pair of electrodes.

An ignition coil control method of controlling discharge currents of a first ignition coil and a second ignition coil of a spark plug provided in an engine according to various exemplary embodiments of the present invention, the ignition coil control method may include receiving a first pulse signal and a second pulse signal following the first pulse signal by a delay time transmitted from an engine control unit; charging the first ignition coil when the first pulse signal is on; charging the second ignition coil when a predetermined time period elapses from a time point at which the first pulse signal is on; discharging the first ignition coil when the first pulse signal is off; discharging the second ignition coil after a maintaining time of the first pulse signal from a time point at which the second ignition coil is charged; when the second pulse signal is on, charging the first ignition coil for a dwell time and then discharging the first ignition coil; and charging the second ignition coil for the dwell time and then discharging the second ignition coil after a predetermined time period elapses from a time point at which the second ignition coil is discharged.

The maintaining time of the first pulse signal may be determined as a time during which the first ignition coil and the second ignition coil are fully charged.

Charging and discharging of the first ignition coil and the second ignition coil may be repeated until the second pulse signal is off.

A discharging period of the first ignition coil and a discharging period of the second ignition coil overlap after the first ignition coil may be initially discharged.

According to various exemplary embodiments of the present invention, it is possible to accurately control, by controlling charging and discharging of two ignition coils by use of two pulse signals transmitted from an engine control unit, an ignition timing in a combustion chamber through spark discharge generated between a center electrode and a ground electrode.

The methods and apparatuses of the present invention have other features and advantages which will be apparent from or are set forth in more detail in the accompanying drawings, which are incorporated herein, and the following Detailed Description, which together serve to explain certain principles of the present invention.

Figure 1:
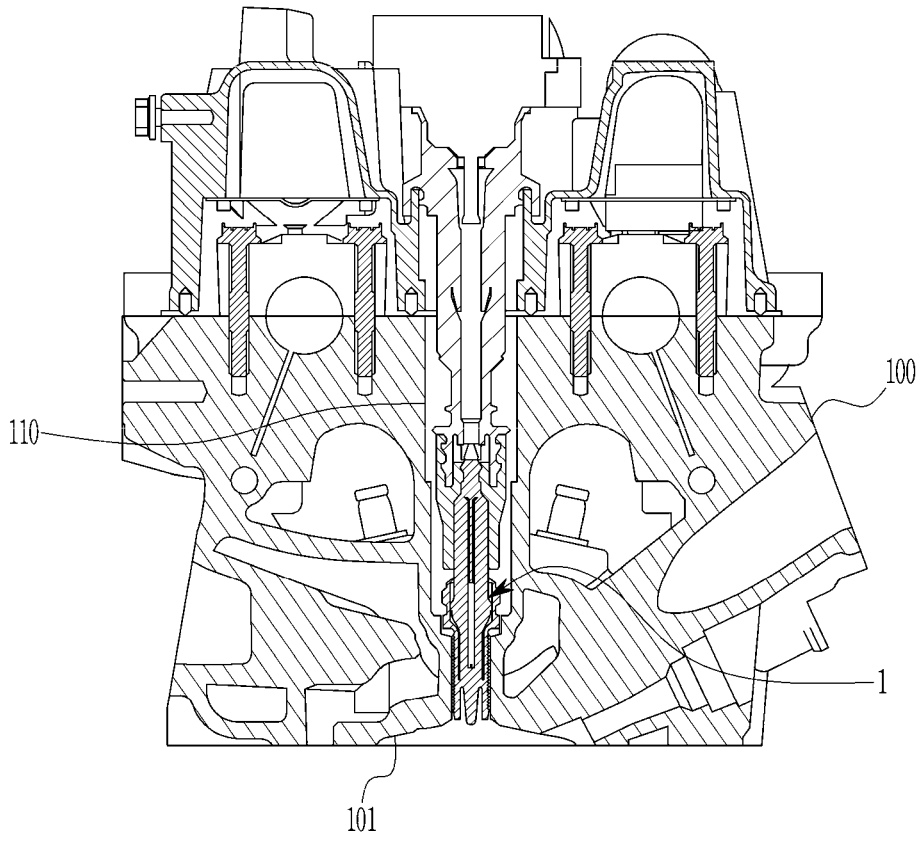
FIG. 1 illustrates a cross-sectional view of an engine in which a spark plug is mounted according to various exemplary embodiments of the present invention.

It may be understood that the appended drawings are not necessarily to scale, presenting a somewhat simplified representation of various features illustrative of the basic principles of the invention. The specific design features of the present invention as disclosed herein, including, for example, specific dimensions, orientations, locations, and shapes will be determined in part by the particularly intended application and use environment.

In the figures, reference numbers refer to the same or equivalent parts of the present invention throughout the several figures of the drawing.

DETAILED DESCRIPTION

Reference will now be made in detail to various embodiments of the present invention(s), examples of which are illustrated in the accompanying drawings and described below. While the invention(s) will be described in conjunction with exemplary embodiments of the present invention, it will be understood that the present description is not intended to limit the invention(s) to those exemplary embodiments. On the other hand, the invention(s) is/are intended to cover not only the exemplary embodiments of the present invention, but also various alternatives, modifications, equivalents and other embodiments, which may be included within the spirit and scope of the invention as defined by the appended claims.

Exemplary embodiments of the present application will be described more fully hereinafter with reference to the accompanying drawings, in which exemplary embodiments of the invention are shown. As those skilled in the art would realize, the described embodiments may be modified in various different ways, all without departing from the spirit or scope of the present invention.

In order to clearly describe the present invention, parts that are irrelevant to the description are omitted, and identical or similar constituent elements throughout the specification are denoted by the same reference numerals.

Furthermore, since the size and thickness of each configuration shown in the drawings are arbitrarily shown for convenience of description, the present invention is not necessarily limited to configurations illustrated in the drawings, and in order to clearly illustrate several parts and areas, enlarged thicknesses are shown.

Hereinafter, a control system of an ignition coil according to various exemplary embodiments of the present invention will be described in detail with reference to the accompanying drawings.

FIG. 1 illustrates a cross-sectional view of an engine in which a spark plug is mounted according to various exemplary embodiments of the present invention.

As shown in FIG. 1, a spark plug 1 according to various exemplary embodiments of the present invention is mounted on a cylinder of an engine, and generates spark discharge.

The engine to which the spark plug 1 is applied includes a cylinder block and a cylinder head 100, and the cylinder block and the cylinder head 100 are combined to form a combustion chamber 101 therein. An air and fuel mixture inflowing into the combustion chamber 101 is ignited by spark discharge generated by the spark plug 1.

In the cylinder head 100, a mount hole 110 in which the spark plug 1 is mounted is vertically formed long. A lower portion of the spark plug 1 which is mounted in the mount hole 110 protrudes into the combustion chamber 101. A center electrode 2 and a ground electrode 3 that are electrically connected to an ignition coil are formed at the lower portion of the spark plug 1, and the spark discharge is generated between the center electrode 2 and the ground electrode 3.

Figure 2:
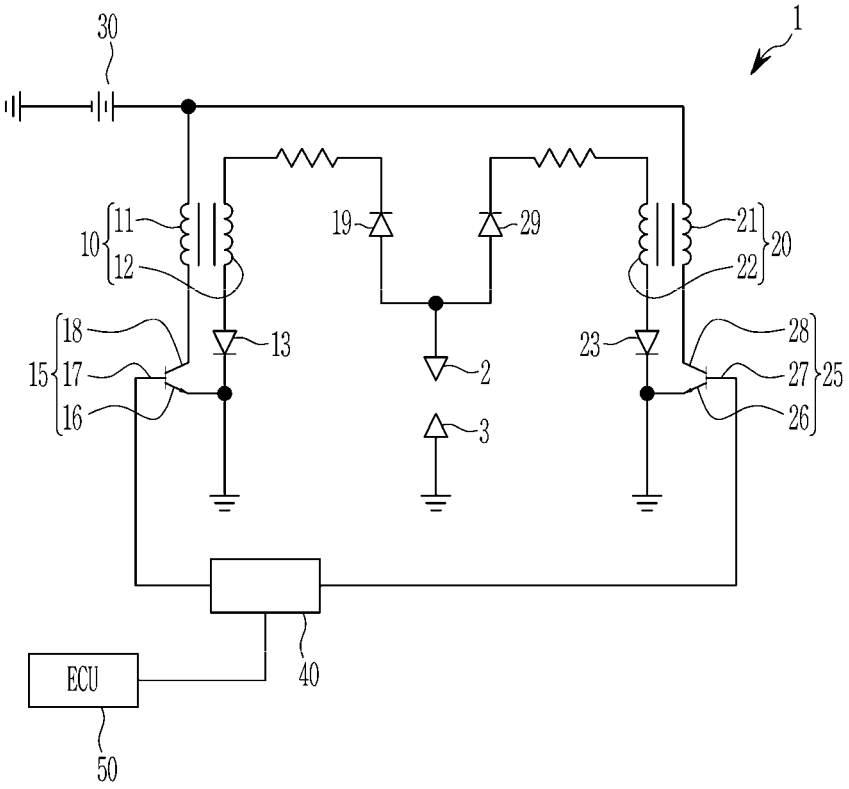
FIG. 2 illustrates a schematic view of an ignition coil control system according to various exemplary embodiments of the present invention.

FIG. 2 illustrates a schematic view of an ignition coil control system according to various exemplary embodiments of the present invention.

As shown in FIG. 2, an ignition coil control system according to various exemplary embodiments of the present invention may include an ignition controller 40 that adjusts amounts and durations of discharge currents of two ignition coils (a first ignition coil 10 and a second ignition coil 20) based on a first pulse signal a second pulse signal followed by a delay time of the first pulse signal having constant voltages transmitted from an engine control unit 50 that controls an overall operation of an engine to control spark discharge generated at the electrodes.

The first ignition coil 10 includes a primary coil 11 and a secondary coil 12, one end portion of the primary coil 11 is electrically connected to a battery 30 of a vehicle, and the other end portion of the primary coil 11 is grounded through a first switch 15. According to an on/off operation of the first switch 15, the primary coil 11 of the first ignition coil 10 may be selectively electrically connected.

The first switch 15 may be realized with a transistor switch (for example, an insulated gate bipolar transistor (IGBT)) including an emitter terminal 16, a collector terminal 18, and a base terminal 17. That is, the other end portion of the primary coil 11 may be electrically connected to the collector terminal 18 of the first switch 15, the emitter terminal 16 thereof may be grounded, and the base terminal 17 thereof may be electrically connected to the ignition controller 40.

One end portion of the secondary coil 12 is electrically connected to the center electrode 2, and the other end portion thereof is electrically connected to the emitter terminal 16 of the first switch 15. A diode 13 is provided between the secondary coil 12 and the emitter terminal 16 to block a current from flowing from the secondary coil 12 to the emitter terminal 16.

Furthermore, a diode 19 is provided between the secondary coil 12 and the center electrode 2, so that a current flows only from the secondary coil 12 to the center electrode 2.

When a control signal is applied to the base terminal 17 of the first switch 15 by the ignition controller 40, the primary coil 11 of the first ignition coil 10 is electrically connected, and electrical energy is charged to the primary coil 11. When no control signal is applied to the base terminal 17 of the first switch 15 by the ignition controller 40, a high voltage current (or discharge current) is generated in the secondary coil 12 due to electromagnetic induction of the primary coil 11 and the secondary coil 12. The discharge current generated in the secondary coil 12 flows to the center electrode 2, and while spark discharge being generated between the center electrode 2 and the ground electrode 3 by the discharge current generated in the secondary coil 12, an air-fuel mixture inside the combustion chamber 101 is ignited.

That is, the ignition controller 40 charges or discharges the first ignition coil 10 by turning on/off the first switch 15. When the ignition controller 40 applies a control signal to the base terminal 17 of the first switch 15 (or when the switch is turned on), the primary side coil 11 is charged (or the first ignition coil is charged).

Furthermore, when the ignition controller 40 does not apply a control signal to the base terminal 17 of the first switch 15 (or when the first switch is turned off), a high voltage current is generated in the secondary coil 12 due to electromagnetic induction with the primary coil 11, and spark discharge is generated between the center electrode 2 and the ground electrode 3 (or the first ignition coil is discharged) by the high voltage current generated in the secondary coil 12.

Like the first ignition coil 10, the second ignition coil 20 includes a primary coil 21 and a secondary coil 22, one end portion of the primary coil 21 is electrically connected to the battery 30 of the vehicle, and the other end portion of the primary coil 21 is grounded through a second switch 25. According to an on/off operation of the second switch 25, the primary coil 21 of the second ignition coil 20 may be selectively electrically connected.

The second switch 25 may be realized with a transistor switch (for example, an insulated gate bipolar transistor (IGBT)) including an emitter terminal 26, a collector terminal 28, and a base terminal 27. That is, the other end portion of the primary coil 21 may be electrically connected to the collector terminal 28 of the second switch 25, the emitter terminal 26 thereof may be grounded, and the base terminal 27 thereof may be electrically connected to the ignition controller 40.

One end portion of the secondary coil 22 is electrically connected to the center electrode 2, and the other end portion thereof is electrically connected to the emitter terminal 26 of the second switch 25. A diode 23 is provided between the secondary coil 22 and the emitter terminal 26 to block a current from flowing from the secondary coil 22 to the emitter terminal 26.

Furthermore, the diode 23 is provided between the secondary coil 22 and the center electrode 2, so that a current flows only from the secondary coil 22 to the center electrode 2.

When a control signal is applied to the base terminal 27 of the second switch 25 by the ignition controller 40, the primary coil 21 of the second ignition coil 20 is electrically connected, and electrical energy is charged to the primary coil 21. When no control signal is applied to the base terminal 27 of the second switch 25 by the ignition controller 40, a high voltage current (or discharge current) is generated in the secondary coil 22 due to electromagnetic induction of the primary coil 21 and the secondary coil 22. The discharge current generated in the secondary coil 22 flows to the center electrode 2, and while spark discharge being generated between the center electrode 2 and the ground electrode 3 by the discharge current generated in the secondary coil 22, an air-fuel mixture inside the combustion chamber 101 is ignited.

That is, the ignition controller 40 charges or discharges the second ignition coil 20 by turning the second switch 25 on/off. When the ignition controller 40 applies a control signal to the base terminal 27 of the second switch 25 (or when the switch is turned on), the primary side coil 21 is charged (or the second ignition coil is charged).

Furthermore, when the ignition controller 40 does not apply a control signal to the base terminal 27 of the second switch 25 (or when the second switch is turned off), a high voltage current is generated in the secondary coil 22 due to electromagnetic induction with the primary coil 21, and spark discharge is generated between the center electrode 2 and the ground electrode 3 (or the second ignition coil is discharged) by the high voltage current generated in the secondary coil 22.

In the specification of the present invention, charging the primary coil of the first ignition coil 10 by turning on the first switch 15 is referred to as charging the first ignition coil 10, and a high voltage current is induced to the secondary coil of the first ignition coil 10 by turning off the first switch 15 and thus spark discharge occurs between the center electrode 2 and the ground electrode 3 is referred to as the first ignition coil 10 being discharged.

Likewise, charging the primary coil of the second ignition coil 20 by turning on the second switch 25 is referred to as charging the second ignition coil 20, and a high voltage current is induced to the secondary coil of the second ignition coil 20 by turning off the second switch 25 and thus spark discharge occurs between the center electrode 2 and the ground electrode 3 is referred to as the second ignition coil 20 being discharged.

The ignition coil control system according to the exemplary embodiment of the present invention controls the charging and discharging of the two ignition coils based on the pulse signal transmitted from the engine control unit 50, so that it is possible to accurately control the ignition timing of the spark discharge generated between the center electrode 2 and the ground electrode 3.

To the present end, the ignition controller 40 may be provided as at least one processor executed by a predetermined program, and the predetermined program is configured to perform respective steps of a control method of the spark plug 1 according to various exemplary embodiments of the present invention.

Hereinafter, the operation of the ignition coil control system according to the exemplary embodiment of the present invention as described above will be described in detail with reference to the accompanying drawings.

Figure 3:
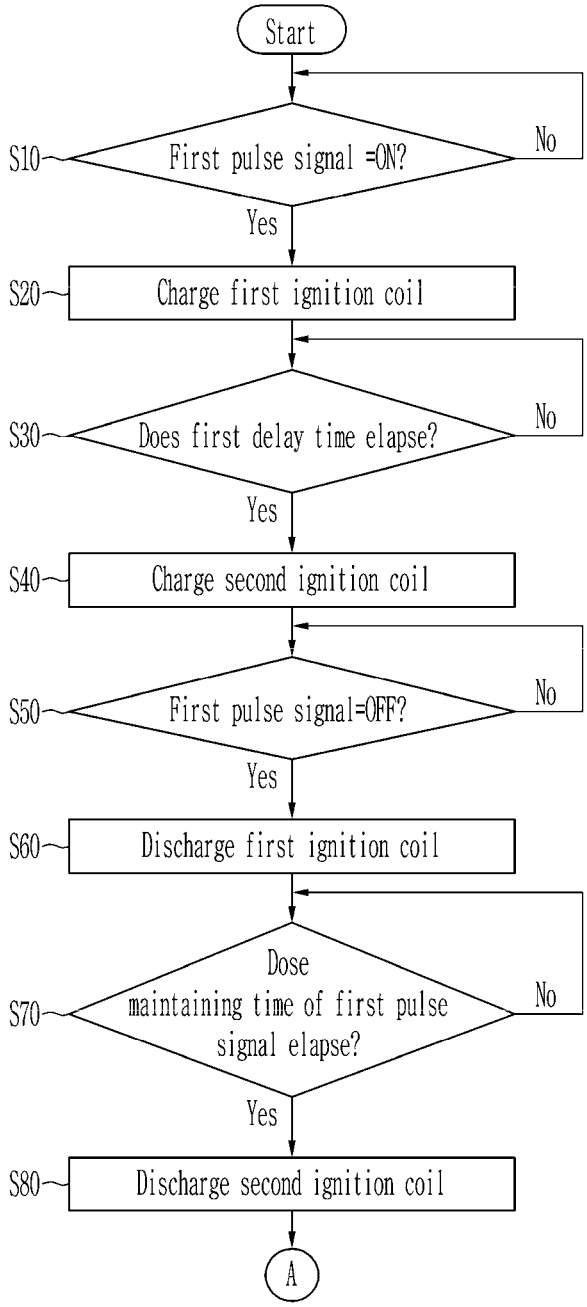
FIG. 3 and FIG. 4 illustrate flowcharts of an ignition coil control method according to various exemplary embodiments of the present invention.
Figure 4:
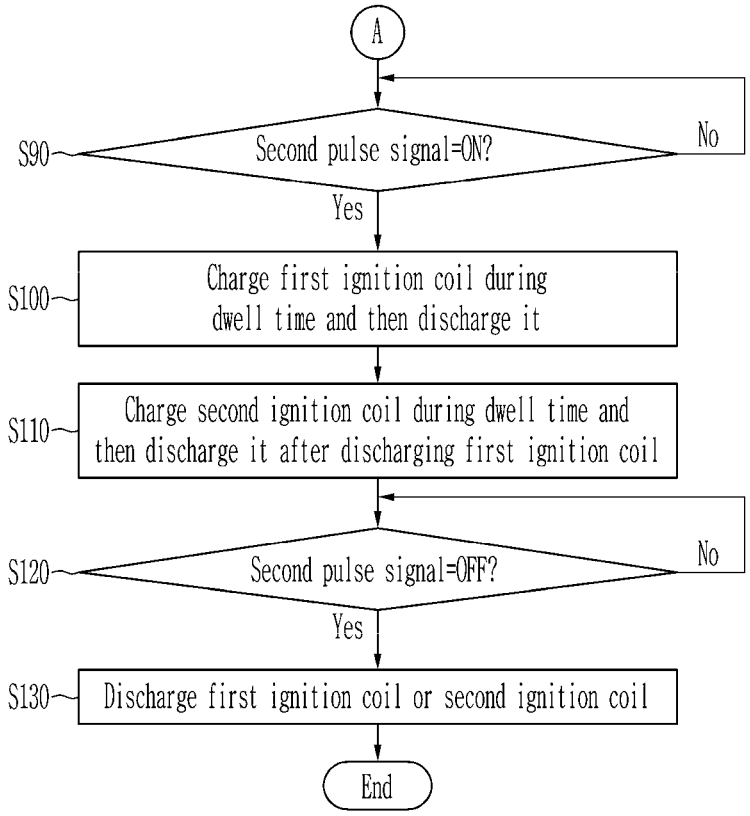

FIG. 3 and FIG. 4 illustrate flowcharts of an ignition coil control method according to various exemplary embodiments of the present invention. Furthermore, FIG. 5 illustrates an operation of two ignition coils according to various exemplary embodiments of the present invention.

Figure 5:
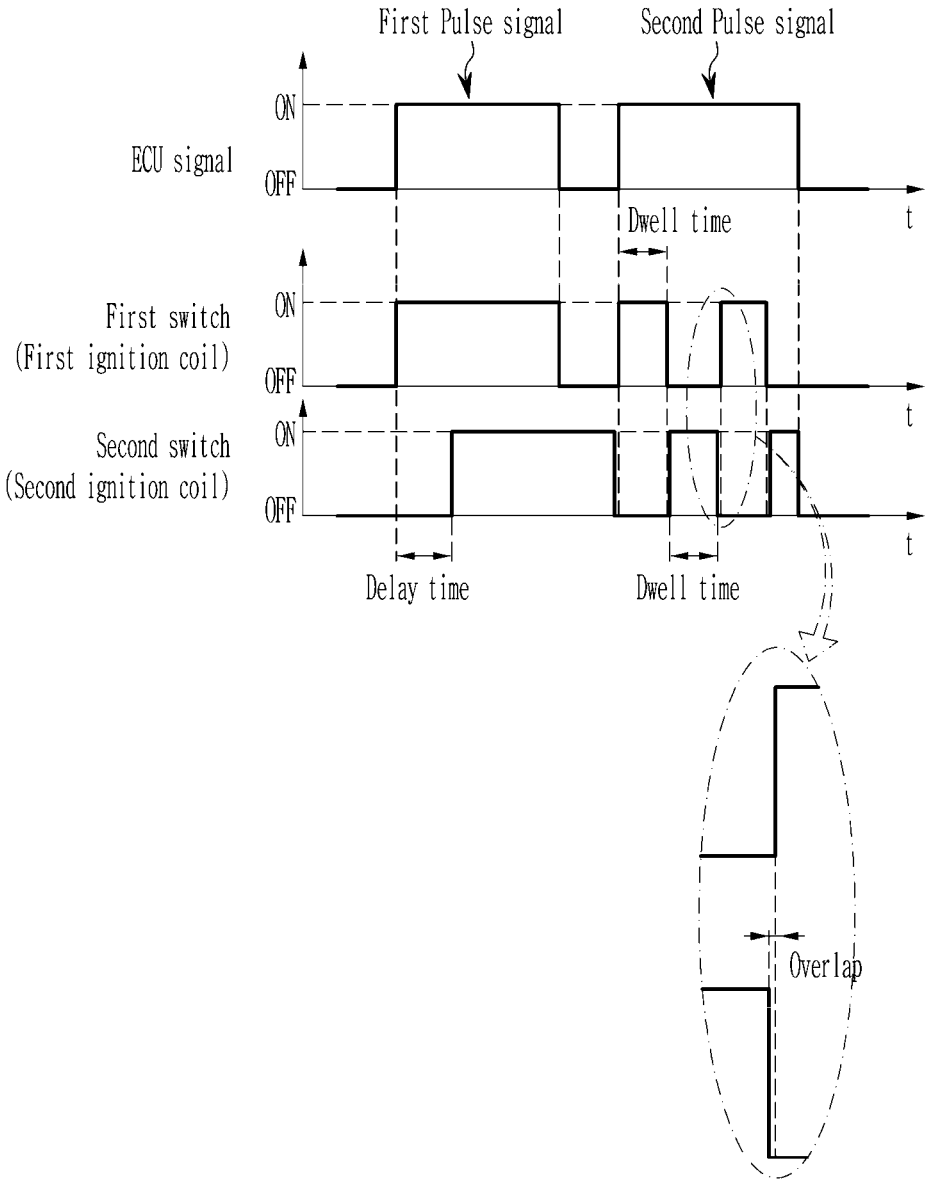
FIG. 5 illustrates an operation of two ignition coils according to various exemplary embodiments of the present invention.

An ignition coil control method according to various exemplary embodiments of the present invention, in an engine including a spark plug generating spark discharge caused by a high voltage current generated by a first ignition coil and a second ignition coil, controls discharge current As shown in FIG. 3 to FIG. 5, the engine control unit (ECU) 50 transmits a pulse signal (or ECU signal) to the ignition controller 40 to ignite the air-fuel mixture inflowing into the combustion chamber 101 during an explosion stroke of the engine. In the instant case, the pulse signal includes a first pulse signal having constant voltage (e.g., 12V) and a predetermined time period and a second pulse signal followed by a predetermined delay time of the first pulse signal transmitted from the engine control unit 50. The second pulse signal has same voltage (e.g., 12V) as the first pulse signal.

Here, a period of the first pulse signal (maintaining time of first pulse signal) may be determined as a time during which the first ignition coil 10 and the second ignition coil 20 are fully charged. In the instant case, the time during which the first ignition coil 10 and the second ignition coil 20 are fully charged may be changed according to the output voltage of the battery 30. For example, when the output voltage of the battery 30 is high, the maintaining time of the first pulse signal may be shortened, and when the output voltage of the battery 30 is low, the maintaining time of the first pulse signal may be lengthened.

When the pulse signal is transmitted from the engine control unit 50, the ignition controller 40 charges and then discharges the first ignition coil 10 in synchronization with the first pulse signal. That is, the ignition controller 40 turns on the first switch 15 to charge the first ignition coil 10 in synchronization with ON time of the pulse signal (or, when the first pulse signal is on) at step S20.

When a first delay time elapses from the time point at which the first pulse signal is on at step S30, the ignition controller 40 turns on the second switch 25 to charge the second ignition coil 20 at step S40.

The ignition controller 40 turns off the first switch 15 to discharge the first ignition coil 10 in synchronization with OFF time of the first pulse signal. That is, when the first pulse signal is off at step S50, the ignition controller 40 turns off the first switch 15 to discharge the first ignition coil 10 at step S60.

When the maintaining time of the first pulse signal elapses from the charging time point of the second ignition coil 20 at step S70, the ignition controller 40 discharges the second ignition coil 20 by turning off the second switch 25 at step S80.

The ignition controller 40 charges and then discharges the first ignition coil 10 in synchronization with the second pulse signal. That is, when the first pulse signal is on at step S90, the ignition controller 40 turns on the first switch 15 to charge the first ignition coil 10 during a dwell time and then discharge the first ignition coil 10 at step S100. Here, the dwell time may be shorter than the maintaining time of the first pulse signal, and shorter than the maintaining time of the second pulse signal.

After the first ignition coil 10 is discharged, the ignition controller 40 charges the second ignition coil 20 during the dwell time and then discharged the second ignition coil 20 at step S110.

When the second pulse signal is not turned off at S120, steps S100 and S110 repeated. That is, the ignition controller 40 repeats charging and discharging of the first ignition coil 10 and the second ignition coil 20 until the second pulse signal is off.

In the instant case, after the first ignition coil 10 is initially discharged, the ignition controller 40 adjusts the charging timing and discharging timing of the first ignition coil 10, and the charging timing and discharging timing of the second ignition coil 20, so that a charging period of the first ignition coil 10 and a charging period of the second ignition coil 20 do not overlap. In other words, after the first ignition coil 10 is initially discharged, the discharging period of the first ignition coil 10 and the discharging period of the second ignition coil 20 may overlap.

As described above, when the discharging period of the first ignition coil 10 and the discharging period of the second ignition coil 20 overlap, the spark discharge is continuously generated between the center electrode 2 and the ground electrode 3, and ignition energy may be efficiently transmitted to the air-fuel mixture in the combustion chamber 101. Therefore, the discharge efficiency of the spark plug 1 may be improved.

When the second pulse signal is off at step S120, the ignition controller 40 discharges the first ignition coil 10 or the second ignition coil 20 at step S130. For example, when the second pulse signal is off while the first ignition coil 10 is being charged, the ignition controller 40 discharges the first ignition coil 10 when the second pulse signal is off. Furthermore, when the second pulse signal is off while the second ignition coil 20 is being charged, the ignition controller 40 discharges the second ignition coil 20 when the second pulse signal is off.

According to various exemplary embodiments of the present invention, by controlling the charging and discharging of the two ignition coils by use of two pulse signals transmitted from the engine control unit 50, the ignition timing in the combustion chamber 101 through the spark discharge generated between the center electrode 2 and the ground electrode 3 may be accurately controlled.

Furthermore, by use of the two pulse signals transmitted from the engine control unit 50, the multi-stage ignition of the spark plug may be easily controlled. That is, by fully charging and the discharging the first ignition coil 10 and second ignition coil 20 by use of the preceding first pulse signal, the multi-stage ignition of the spark plug may be easily controlled. Furthermore, multi-stage ignition may be easily implemented by repeating the charging and discharging of the first ignition coil 10 and the second ignition coil 20 based on the following the second pulse signal.

Through this, the initial combustion speed is prevented from increasing, and knocking is prevented, so that the engine output and fuel economy may be improved. Furthermore, even when the ignition property of the air-fuel mixture is degraded, such as when exhaust gas recirculation (EGR) gas is supplied to the combustion chamber 101 of the engine or a lean combustion occurs, sufficient ignition energy may be supplied into the combustion chamber 101.

Furthermore, the term related to a control device such as "controller", "control unit", "control device" or "control module", etc refers to a hardware device including a memory and a processor configured to execute one or more steps interpreted as an algorithm structure. The memory stores algorithm steps, and the processor executes the algorithm steps to perform one or more processes of a method in accordance with various exemplary embodiments of the present invention. The control device according to exemplary embodiments of the present invention may be implemented through a nonvolatile memory configured to store algorithms for controlling operation of various components of a vehicle or data about software commands for executing the algorithms, and a processor configured to perform operation to be described above using the data stored in the memory. The memory and the processor may be individual chips. Alternatively, the memory and the processor may be integrated in a single chip. The processor may be implemented as one or more processors. The processor may include various logic circuits and operation circuits, may process data according to a program provided from the memory, and may generate a control signal according to the processing result.

The control device may be at least one microprocessor operated by a predetermined program which may include a series of commands for carrying out the method disclosed in the aforementioned various exemplary embodiments of the present invention.

The aforementioned invention can also be embodied as computer readable codes on a computer readable recording medium. The computer readable recording medium is any data storage device that can store data which may be thereafter read by a computer system. Examples of the computer readable recording medium include hard disk drive (HDD), solid state disk (SSD), silicon disk drive (SDD), read-only memory (ROM), random-access memory (RAM), CD-ROMs, magnetic tapes, floppy discs, optical data storage devices, etc and implementation as carrier waves (e.g., transmission over the Internet).

In various exemplary embodiments of the present invention, each operation described above may be performed by a control device, and the control device may be configured by multiple control devices, or an integrated single control device.

In various exemplary embodiments of the present invention, the control device may be implemented in a form of hardware or software, or may be implemented in a combination of hardware and software.

For convenience in explanation and accurate definition in the appended claims, the terms "upper", "lower", "inner", "outer", "up", "down", "upwards", "downwards", "front", "rear", "back", "inside", "outside", "inwardly", "outwardly", "interior", "exterior", "internal", "external", "forwards", and "backwards" are used to describe features of the exemplary embodiments with reference to the positions of such features as displayed in the figures. It will be further understood that the term "connect" or its derivatives refer both to direct and indirect connection.

The foregoing descriptions of specific exemplary embodiments of the present invention have been presented for purposes of illustration and description. They are not intended to be exhaustive or to limit the present invention to the precise forms disclosed, and obviously many modifications and variations are possible in light of the above teachings. The exemplary embodiments were chosen and described to explain certain principles of the present invention and their practical application, to enable others skilled in the art to make and utilize various exemplary embodiments of the present invention, as well as various alternatives and modifications thereof. It is intended that the scope of the present invention be defined by the Claims appended hereto and their equivalents.

What is claimed is:

1. An ignition coil control method of controlling discharge currents of a first ignition coil and a second ignition coil of a spark plug provided in an engine, the ignition coil control method comprising:

receiving, by a controller electrically connected to an engine control unit, a first pulse signal and a second pulse signal following the first pulse signal by a delay time, wherein the first pulse signal and the second pulse signal are transmitted from the engine control unit to the controller;

charging, by the controller, the first ignition coil when the first pulse signal is on;

charging, by the controller, the second ignition coil when a predetermined time period elapses from a time point at which the first pulse signal is on;

discharging, by the controller, the first ignition coil when the first pulse signal is off;

discharging, by the controller, the second ignition coil after a maintaining time of the first pulse signal from a time point at which the second ignition coil is charged;

when the second pulse signal is on, charging, by the controller, the first ignition coil for a dwell time and then discharging the first ignition coil; and charging, by the controller, the second ignition coil for the dwell time and then discharging the second ignition coil after a predetermined time period elapses from a time point at which the second ignition coil is discharged.

2. The ignition coil control method of claim 1, wherein the first ignition coil includes a primary coil and a secondary coil, a first end portion of the primary coil is electrically connected to a battery, and a second end portion of the primary coil is grounded through a first switch, wherein the second ignition coil includes a primary coil and a secondary coil, a first end portion of the primary coil in the second ignition coil is electrically connected to the battery, and a second end portion of the primary coil in the second ignition coil is grounded through a second switch, and wherein the first switch and the second switch are electrically connected to the controller and according to an on/off operation of the first switch in accordance with a control signal of the controller, the primary coil of the first ignition coil is selectively electrically connected, and according to an on/off operation of the second switch in accordance with a control signal of the controller, the primary coil of the second ignition coil is selectively electrically connected.

3. The ignition coil control method of claim 1, wherein the maintaining time of the first pulse signal is determined as a time during which the first ignition coil and the second ignition coil are fully charged.

4. The ignition coil control method of claim 1, wherein charging and discharging of the first ignition coil and the second ignition coil are repeated until the second pulse signal is off.

5. The ignition coil control method of claim 3, wherein a discharging period of the first ignition coil and a discharging period of the second ignition coil overlap after the first ignition coil is initially discharged.

6. The ignition coil control method of claim 3, wherein the dwell time is shorter than the maintaining time of the first pulse signal.

7. A non-transitory computer-readable recording medium having recorded thereon instructions executed by at least one processor, the instructions, when executed by the at least one processor, causing the at least one processor to:

receive a first pulse signal and a second pulse signal following the first pulse signal by a delay time;

charge a first ignition coil when the first pulse signal is on;

charge a second ignition coil when a predetermined time period elapses from a time point at which the first pulse signal is on;

discharge the first ignition coil when the first pulse signal is off;

discharge the second ignition coil after a maintaining time of the first pulse signal from a time point at which the second ignition coil is charged;

when the second pulse signal is on, discharge the first ignition coil for a dwell time and then discharging the first ignition coil; and charge the second ignition coil for the dwell time and then discharging the second ignition coil after a predetermined time period elapses from a time point at which the second ignition coil is discharged.

8. An ignition coil control system, comprising:

a controller electrically connected to an engine control unit;

a first switch and a second switch electrically connected to the controller; and a first ignition coil and a second ignition coil, wherein the first ignition coil includes a primary coil and a secondary coil, a first end portion of the primary coil is electrically connected to a battery, and a second end portion of the primary coil is grounded through the first switch, and wherein the second ignition coil includes a primary coil and a secondary coil, a first end portion of the primary coil in the second ignition coil is electrically connected to the battery, and a second end portion of the primary coil in the second ignition coil is grounded through the second switch, and wherein the controller is configured for:

receiving a first pulse signal and a second pulse signal following the first pulse signal by a delay time, from the engine control unit;

charging the first ignition coil by turning on the first switch when the first pulse signal is on;

charging the second ignition coil by turning on the second switch when a predetermined time period elapses from a time point at which the first pulse signal is on;

discharging the first ignition coil by turning off the first switch when the first pulse signal is off;

discharging the second ignition coil by turning off the second switch after a maintaining time of the first pulse signal from a time point at which the second ignition coil is charged;

when the second pulse signal is on, charging the first ignition coil for a dwell time by turning on the first switch and then discharging the first ignition coil by turning off the first switch; and charging the second ignition coil for the dwell time by turning on the second switch and then discharging the second ignition coil by turning off the second switch after a predetermined time period elapses from a time point at which the second ignition coil is discharged.

9. The ignition coil control system of claim 8, wherein the maintaining time of the first pulse signal is determined as a time during which the first ignition coil and the second ignition coil are fully charged.

10. The ignition coil control system of claim 8, wherein charging and discharging of the first ignition coil and the second ignition coil are repeated until the second pulse signal is off.

11. The ignition coil control system of claim 10, wherein a discharging period of the first ignition coil and a discharging period of the second ignition coil overlap after the first ignition coil is initially discharged.

12. The ignition coil control system of claim 10, wherein the dwell time is shorter than the maintaining time of the first pulse signal.

* * * * *